US009666144B2

(12) United States Patent
Chen

(10) Patent No.: US 9,666,144 B2
(45) Date of Patent: May 30, 2017

(54) IMAGE DISPLAY METHOD AND SYSTEM

(71) Applicant: SHENZHEN CHINA STAR OPTOELECTRONICS TECHNOLOGY CO., LTD., Shenzhen, Guangdong (CN)

(72) Inventor: Lixuan Chen, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 191 days.

(21) Appl. No.: 14/387,014

(22) PCT Filed: Aug. 22, 2014

(86) PCT No.: PCT/CN2014/085037
§ 371 (c)(1),
(2) Date: Sep. 22, 2014

(87) PCT Pub. No.: WO2016/026146
PCT Pub. Date: Feb. 25, 2016

(65) Prior Publication Data

US 2016/0247465 A1 Aug. 25, 2016

(30) Foreign Application Priority Data

Aug. 18, 2014 (CN) ..... 2014 1 0410155

(51) Int. Cl.
*G09G 3/36* (2006.01)

(52) U.S. Cl.
CPC ..... *G09G 3/3607* (2013.01); *G09G 3/3685* (2013.01); *G09G 2310/027* (2013.01);
(Continued)

(58) Field of Classification Search
CPC ..... G09G 3/3607; G09G 2320/0233; G09G 2320/0242
See application file for complete search history.

(56) References Cited

U.S. PATENT DOCUMENTS 6,801,220 B2 10/2004 Greier et al.
9,257,076 B2 2/2016 Gong et al.
(Continued)

FOREIGN PATENT DOCUMENTS

CN 1658679 8/2005
CN 101866604 10/2010
(Continued)

OTHER PUBLICATIONS

International Search Report for PCT/CN2014/085037, English Translation attached to original, Both completed by the Chinese Patent Officfe on May 8, 2015, All together 5 Pages.

*Primary Examiner* — Dwayne Bost
*Assistant Examiner* — Maheen Javed
(74) *Attorney, Agent, or Firm* — Brooks Kushman P.C.

(57) ABSTRACT

A image display method is disclosed including: providing a liquid crystal panel including a plurality of pixel units; dividing the liquid crystal panel into a plurality of display units including a first display area which includes a pixel unit, a number of which is a, and a second display area which includes a pixel unit, a number of which is b, wherein, the a and the b are integers larger than 0; providing a data signal of an image; dividing a grayscale G of the data signal of the image corresponding to the pixel unit into a first grayscale Gm and a second grayscale Gs; inputting the first grayscale Gm to the pixel unit of the first display area, inputting the second grayscale Gs to the pixel unit of the second display area, and displaying the image. An image display system realizing the above display method is also provided.

16 Claims, 7 Drawing Sheets

(52) U.S. Cl.
CPC ..... *G09G 2320/0233* (2013.01); *G09G 2320/0242* (2013.01)

(56) References Cited

U.S. PATENT DOCUMENTS

| | | | | |
|---|---|---|---|---|
| 2007/0139323 | A1 | 6/2007 | Chen et al. | |
| 2009/0027323 | A1 | 1/2009 | Choi | |
| 2014/0063080 | A1 | 3/2014 | Wu et al. | |
| 2014/0210878 | A1* | 7/2014 | Broughton ..... | G09G 3/003 345/694 |

FOREIGN PATENT DOCUMENTS

| | | |
|---|---|---|
| CN | 102855842 | 1/2013 |
| CN | 103578444 | 2/2014 |
| CN | 103928011 | 7/2014 |

* cited by examiner

IMAGE DISPLAY METHOD AND SYSTEM

CROSS-REFERENCE TO RELATED APPLICATION

This application is the U.S. national phase of PCT Application No. PCT/CN2014/085037 filed on Aug. 22, 2014, which claims priority to CN Patent Application No. 201410410155.2 filed on Aug. 18, 2014, the disclosures of which are incorporated in their entirety by reference herein.

TECHNICAL FIELD

The present invention relates to a liquid crystal display, and more particularly to an image display method and system.

BACKGROUND ART

A liquid crystal display (LCD) is a flat and ultra-thin display apparatus, which is composed of a certain amount of colorful or black-and-white pixels and disposed in front of a light source or a reflection plate. Power consumption of the liquid crystal display is very low, and the liquid crystal display has characteristics such as high image quality, small volume and low weight, which is accordingly highly appreciated and becomes a mainstream of displays. The liquid crystal display has been widely applied to various electronic products, such as a computer apparatus, a mobile phone or a digital photo frame having a display screen, etc., and a wide view angle technology is one of development emphasis of current liquid crystal displays. However, when a side view angle or a slant view angle is excessively large, a color shift phenomenon generally occurs in a wide view angle liquid crystal display.

As for a problem that color shift occurs in a wide view angle liquid crystal display, a 2D1G technology is adopted in current industry to solve the problem. The so-called 2D1G technology indicates that each of pixel units is divided into a main pixel area and a sub pixel area having different areas in a liquid crystal panel, the main pixel area and the sub pixel area in the same one pixel unit are connected to different data lines and same gate lines. Different display luminance and slant view luminance are generated through inputting different data signals (different grayscale values) to the main pixel area and the sub pixel area so as to reduce color shift generated during side viewing or slant viewing. As for a grayscale value of the pixel unit, how to set grayscale values of the main pixel area and the sub pixel area, respectively, so that a combination of grayscale values of the main pixel area and the sub pixel area can reduce color shift while achieving an excellent display effect, is a problem that needs to be solved. As for dividing the grayscale value of the pixel unit into the combination of two grayscale values, since a design of a hardware chip realizing conversion relies on an algorithm, a conversion effect needs to be simulate-evaluated before the design of the hardware chip to ensure quality of the design of the hardware chip.

SUMMARY

To this end, the present invention aims to provide a display method and display system for an image, which simulate-evaluates a conversion effect by simulating displaying of a 2D1G panel in a traditional RGB three-pixels liquid crystal panel to ensure quality of a hardware chip design.

In order to realize the above purpose, the present invention adopts following technical solutions:

An image display method comprises:

providing a liquid crystal panel including a plurality of pixel units;

dividing the liquid crystal panel into a plurality of display units including a first display area which includes a pixel unit, a number of which is a, and a second display area which includes a pixel unit, a number of which is b, wherein, the a and the b are integers larger than 0;

providing a data signal of an image;

dividing a grayscale G of the data signal of the image corresponding to the pixel unit into a combination of a first grayscale Gm and a second grayscale Gs; and inputting the first grayscale Gm to the pixel unit of the first display area, inputting the second grayscale Gs to the pixel unit of the second display area, and displaying the image.

The dividing of the grayscale G into the combination of the first grayscale Gm and the second grayscale Gs particularly comprises:

S101 obtaining an actual luminance value Lvα of each grayscale G of the liquid crystal panel at a front view angle α;

S102 obtaining an actual luminance value Lvβ of each grayscale G of the liquid crystal panel at a slant view angle β;

S103 dividing each pixel unit of the liquid crystal panel into a main pixel area M and a sub pixel area S with an area ratio of a:b, dividing actual luminance values Lvα and Lvβ according to following equations:

$$LvM\alpha:LvS\alpha=a:b,\ LvM\alpha+LvS\alpha=Lv\alpha;$$

$$LvM\beta:LvS\beta=a:b,\ LvM\beta+LvS\beta=Lv\beta;$$

wherein, actual luminance values LvMα and LvMβ of each grayscale G of the main pixel area M at the front view angle α and the slant view angle β are obtained, respectively; and actual luminance values LvSα and LvSβ of each grayscale G of the sub pixel area S at the front view angle α and the slant view angle β are obtained, respectively;

S104 calculating theoretical luminance values LvGα and LvGβ of each grayscale G of the liquid crystal panel at the front view angle α and the slant view angle β according to actual luminance values Lvα(max) and Lvβ(max) of a highest grayscale max obtained in steps S101 and S102, in conjunction with following equations:

$$\text{gamma}(\gamma) = 2.2 \text{ and } \left(\frac{G}{\max}\right)^{\gamma} = \frac{LvG}{Lv(\max)};$$

S105 as for a grayscale Gx in the pixel unit, assuming that grayscales input to the main pixel area M and the sub pixel area S are Gmx and Gsx, respectively, obtaining actual luminance values LvMxα, LvMxβ, LvSxα and LvSxβ according to a result of step S103, obtaining theoretical luminance values LvGxα and LvGxβ according to a result of step S104; and calculating following equations:

$$\Delta 1=LvMx\alpha+LvSx\alpha-LvGx\alpha;$$

$$\Delta 2=LvMx\beta+LvSx\beta-LvGx\beta;$$

$$y=\Delta 1^2+\Delta 2^2;$$

wherein, when y is minimal, setting corresponding grayscales Gmx and Gsx to be grayscales respectively input to the main pixel area M and the sub pixel area S when the pixel unit is at the grayscale Gx; and

S106 repeating step S105 with respect to each grayscale G of the pixel unit to complete dividing of the grayscale G into the combination of the first grayscale Gm and the second grayscale Gs.

The front view angle α is 0°, and the slant view angle β is 30-80°.

The slant view angle β is 60°.

The grayscales of the liquid crystal panel includes 256 grayscales from 0-255, wherein the highest grayscale max is grayscale 255.

The actual luminance values Lvα and Lvβ are determined according to gamma curves which are gamma curves of the liquid crystal panel obtained at the front view angle α and the slant view angle β.

After step S106, a Gm-Lv relationship curve between the grayscale and the luminance of the main pixel area M and the Gs-Lv relationship curve between the grayscale and the luminance of the sub pixel area S are obtained, and a singular point appearing in the Gm-Lv relationship curve and the Gs-Lv relationship curve is processed by adopting a Locally weighted regression scatter plot smoothing method or a power function fitting process, wherein an expression of the power function is: f=m*x^n+k.

In step S105, a judgment condition is added:

$$Gmx \geq Gm(x-1),\ Gsx \geq Gs(x-1);$$

wherein, when the condition Gmx≥Gm(x−1), Gsx≥Gs(x−1) is satisfied and y is minimal, the corresponding grayscales Gmx and Gsx are set to be grayscales respectively input to the main pixel area M and the sub pixel area S when the pixel unit is at the grayscale Gx.

a:b=2:1 or 3:1.

Another aspect of the present invention provides an image display system, which comprises:

a liquid crystal panel which is divided into a plurality of display units including a first display area which includes a pixel unit, a number of which is a, and a second display area which includes a pixel unit, a number of which is b, wherein the a and the b are integers larger than 0;

a data signal receiving unit for receiving a data signal of an image; and a data signal processing unit coupled to the data signal receiving unit for dividing a grayscale G of the data signal of the image corresponding to the pixel unit into a combination of a first grayscale Gm and a second grayscale Gs, wherein, the data signal processing unit being coupled to the liquid crystal panel, inputting the first grayscale Gm to the pixel unit of the first display area, inputting the second grayscale Gs to the pixel unit of the second display area, and displaying the image in the liquid crystal panel.

Advantageous Effects

The image display method and system provided by the present invention can simulate-evaluate a conversion effect when converting a grayscale value of a pixel unit into a combination of grayscales of a main pixel area and a sub pixel area in order to reduce color shift by simulating display of a 2D1 G panel in a traditional RGB three-pixel liquid crystal panel, to ensure quality of a hardware chip design.

DETAILED DESCRIPTION OF EXEMPLARY EMBODIMENTS

In order for the purpose, technical solution and advantages of the present invention to be clearer and understood, the present invention will be further explained below in conjunction with the drawings using embodiments.

Figure 1:
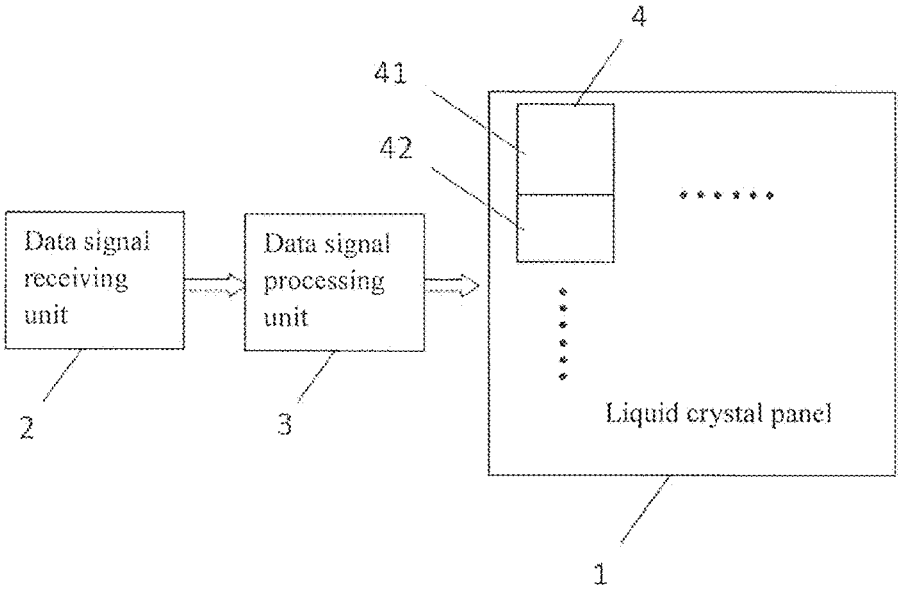
FIG. 1 is a block diagram of a display system provided by an embodiment of the present invention.
Figure 2:
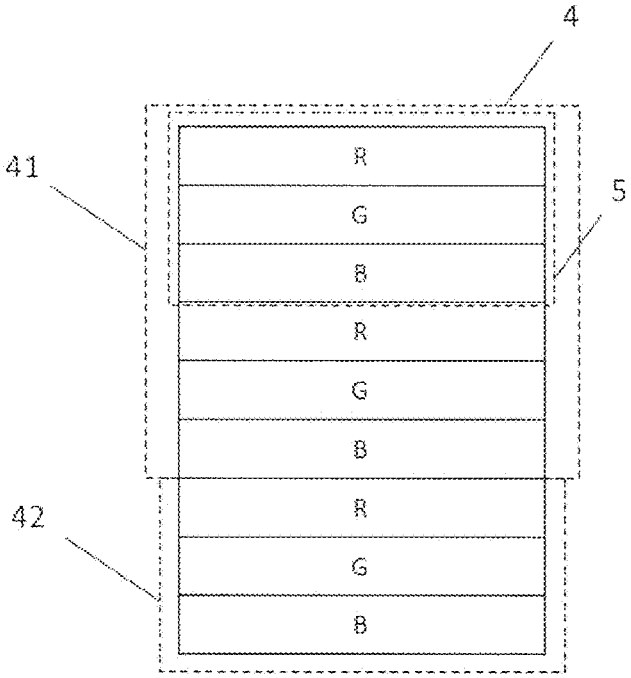
FIG. 2 is a schematic diagram of a display area of a liquid crystal panel provided by an embodiment of the present invention.

Referring to FIGS. 1 and 2, an image display system provided by the present embodiment includes:

a traditional liquid crystal panel 1 includes a plurality of pixel units 5, each of which includes a red sub pixel R, a green sub pixel G and a blue sub pixel B. The liquid crystal panel 1 is divided into a plurality of display units 4 (FIG. 1 is only exemplary one of them) which include a first display area 41 and a second display area 42, wherein, the first display area 41 includes the pixel unit 5, the number of which is a, and the second display area 42 includes the pixel unit 5, the number of which is b, so that two display areas with an area ratio of a:b are formed in display units 4. In the present embodiment, as illustrated in FIG. 2, the first display area 41 includes two pixel units 5, the second display area 42 includes one pixel units 5, that is, the area ratio of the first display area 41 and the second display area 42 is 2:1. The a and the b may be any integers larger than 0, the area ratio of the first display area 41 and the second display area 42 is determined according to needs, and preferably, the ratio is 2:1 or 3:1.

The display system further includes a data signal receiving unit 2 and a data signal processing unit 3, wherein the data signal receiving unit 2 is used for receiving a data signal of the image; the data signal processing unit 3 is coupled to the data signal receiving unit 2 to divide a grayscale G of the data signal of the image corresponding to the pixel unit 5 into a combination of a first grayscale Gm and a second grayscale Gs, then, the first grayscale Gm is input to the pixel unit 5 of the first display area 41, the second grayscale Gs is input to the pixel unit 5 of the second display area 42, and the image is displayed in the liquid crystal panel 1.

Figure 3:
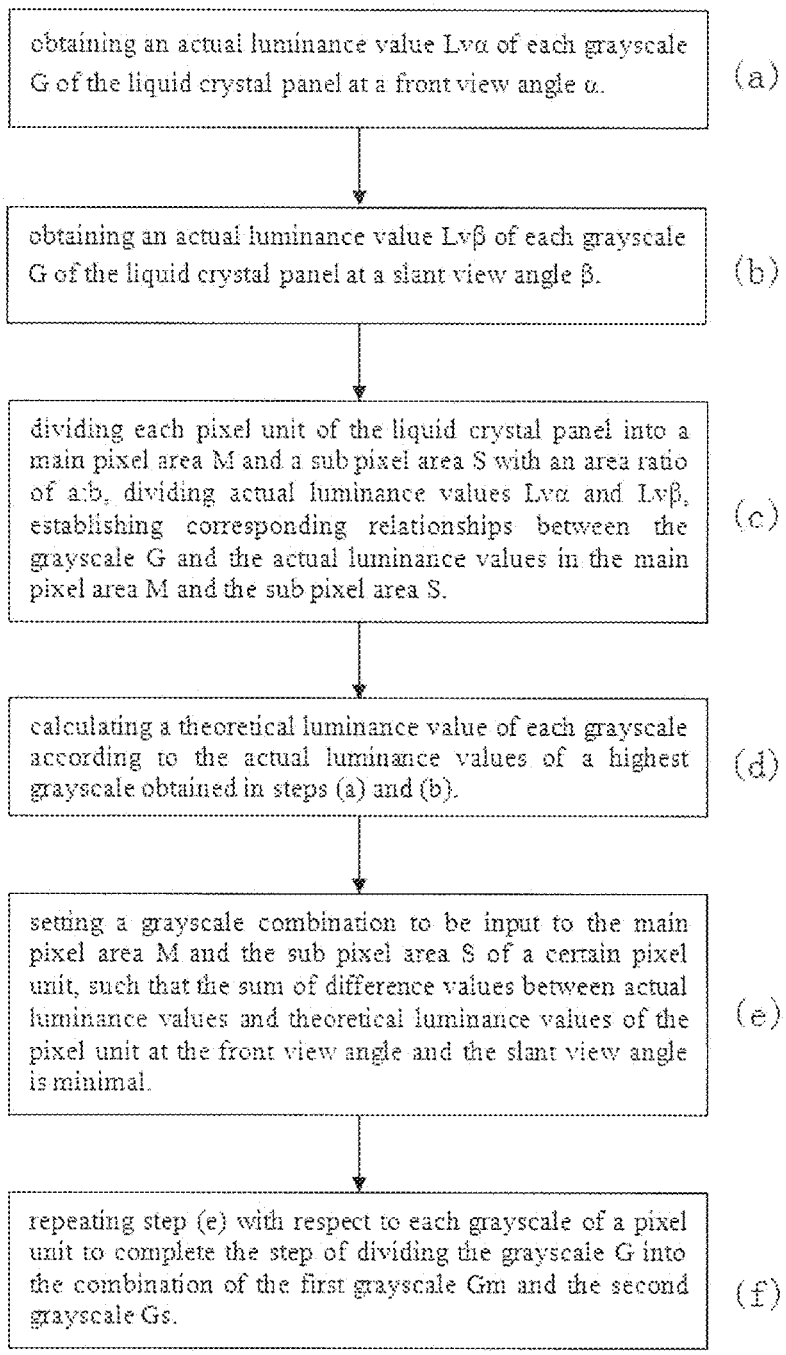
FIG. 3 is a flowchart of a grayscale conversion method provided by an embodiment of the present invention.

As illustrated in the flowchart of FIG. 3, the dividing of the grayscale G into a combination of the first grayscale Gm and the second grayscale Gs particularly includes:

(a) An actual luminance value Lvα of each grayscale G of the liquid crystal panel at a front view angle α obtained;

(b) An actual luminance value Lvβ of each grayscale G of the liquid crystal panel at a slant view angle β is obtained;

(c) Each pixel unit of the liquid crystal panel is divided into a main pixel area M and a sub pixel area S with the area ratio of a:b, actual luminance values Lvα and Lvβ are divided, and a corresponding relationship between the grayscale G and actual luminance values in the main pixel area M and the sub pixel area S is established. The dividing is performed according to following equations:

$$LvM\alpha:LvS\alpha=a:b,\ LvM\alpha+LvS\alpha=Lv\alpha;$$

$$LvM\beta:LvS\beta=a:b,\ LyM\beta+LvS\beta=Lv\beta;$$

wherein, actual luminance values LvMα and LvMβ of each grayscale G of the main pixel area M at the front view angle α and the slant view angle β are obtained, respectively; actual luminance values LvSα and LvSβ of each grayscale G of the sub pixel area S at the front view angle α and the slant view angle β are obtained, respectively;

(d) A theoretical luminance value of each grayscale is calculated according to the actual luminance values of a highest grayscale obtained in steps (a) and (b). For example, theoretical luminance values LvGα and LvGβ of each grayscale G of the liquid crystal panel at the front view angle α and the slant view angle β are calculated according to the actual luminance values of the highest grayscale max Lvα (max) and Lvβ(max) in conjunction with equations:

$$\text{gamma}(\gamma) = 2.2;\ \text{and}\ \left(\frac{G}{\max}\right)^{\gamma} = \frac{LvG}{Lv(\max)};$$

(e) A grayscale combination to be input to a main pixel area M and a sub pixel area S of a certain pixel unit is set, such that the sum of difference values between actual luminance values and theoretical luminance values of the pixel unit at the front view angle and the slant view angle is minimal. Particularly, as for a grayscale Gx in the pixel unit, supposing that grayscales input to the main pixel area M and the sub pixel area S are Gmx and Gsx, respectively, actual luminance values LvMxα, LvMxβ, LvSxα and LvSxβ are obtained according to the result of step (c), and theoretical luminance values LvGxα and LvGxβ are obtained according to the result of step (d); following equations are calculated:

$$\Delta1=LvMx\alpha+LvSx\alpha-LvGx\alpha;$$

$$\Delta2=LvMx\beta+LvSx\beta-LvGx\beta;$$

$$y=\Delta1^2+\Delta2^2;$$

When y is minimal, setting the corresponding grayscales Gmx and Gsx to be grayscales respectively input to the main pixel area M and the sub pixel area S when the pixel unit is at the grayscale Gx; and (f) Step (e) is repeated with respect to each grayscale of a pixel unit, to complete the step of dividing the grayscale G into the combination of the first grayscale Gm and the second grayscale Gs.

In the present embodiment, the front view angle α is 0°, and the slant view angle β is 60°. In some other embodiments, the slant view angle β may also be selected in a range from 30-80°. Herein, the front view angle indicates a front view angle direction of the liquid crystal display, and the slant view angle indicates an angle formed opposite to the front view angle direction of the liquid crystal display.

In the present embodiment, grayscales of the liquid crystal panel include 256 grayscales from 0-255, wherein the highest grayscale max is grayscale 255.

Below is a detailed example that the area ratio of the main pixel area M and the sub pixel area S is a:b=2:1, the front view angle α=0°, and the slant view angle β=60°.

Figure 4:
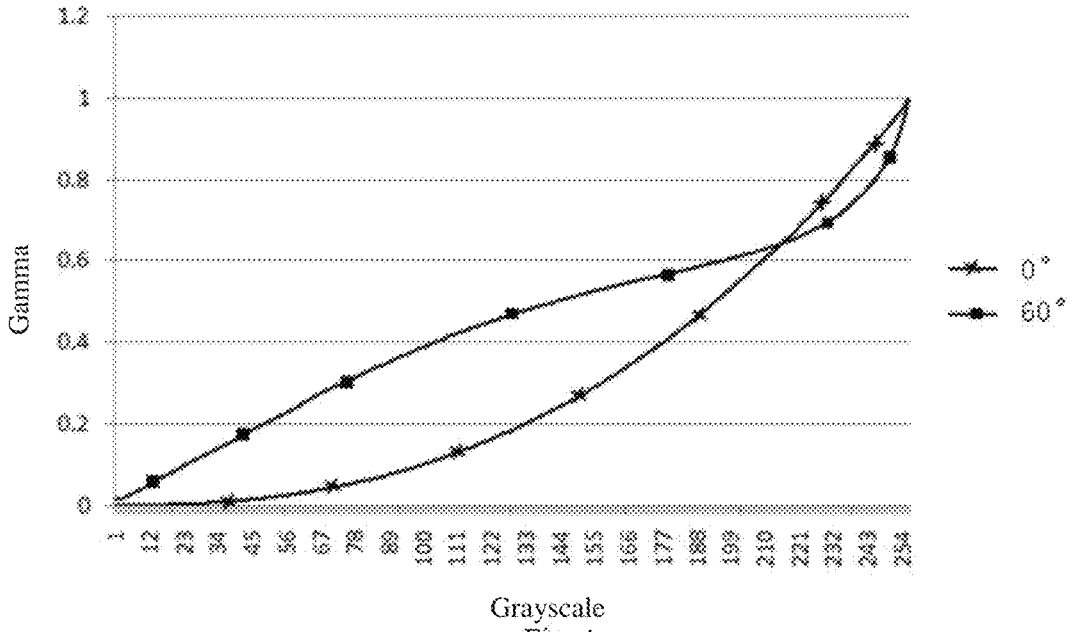
FIG. 4 is a diagram illustrating gamma curve of a liquid crystal panel before grayscale adjustment provided by an embodiment of the present invention.

First, a gamma curve of a liquid crystal panel at the front view angle 0° and the slant view angle 60° is obtained, as illustrated in FIG. 4. Actual luminance values Lv0(0-255) and Lv60(0-255) of each grayscale G (0-255) at the front view angle 0° and the slant view angle 60° are obtained according to the gamma curve.

Then, actual luminance values Lv0 and Lv60 are divided into LvM0, LvS0, LvM60 and LvS0 according to the area ratio of the main pixel area M and the sub pixel area S, namely, a:b=2:1, LvM0, LvS0, LvM60 and LvS0 satisfy following conditions:

$$LvM0:LvS0=2:1,\ LvM0+LvS0=Lv0;$$

$$LvM60:LvS60=2:1,\ LvM60+LvS60=Lv60;$$

Actual luminance values LvM0(0-255) and LvM60(0-255) of each grayscale G (0-255) of the main pixel area M at the front view angle 0° and the slant view angle 60° are obtained; actual luminance values LvS0(0-255) and LvS60 (0-255) of each grayscale G (0-255) of the sub pixel area S at the front view angle 0° and the slant view angle 60° are obtained, and corresponding relationships between the grayscale G and the actual luminance values in the main pixel area M and the sub pixel area S is established.

Further, according to actual luminance values Lv0(255) and Lv60(255) of the highest grayscale 255, in conjunction with equations:

$$\text{gamma}(\gamma) = 2.2,\ \text{and}\ \left(\frac{G}{255}\right)^{\gamma} = \frac{LvG}{Lv(255)},$$

theoretical luminance values LvG0(0-255) and LvG60(0-255) of each grayscale G (0-255) of the liquid crystal panel at the front view angle 0° and the slant view angle 60° are calculated, corresponding relationships between the grayscale G and the theoretical luminance values are established.

Further, as for a grayscale Gx (Gx is one of 0-255) of a pixel unit, supposing that grayscales input to the main pixel area M and the sub pixel area S are Gmx and Gsx, respectively, actual luminance values LvMx0, LyMx60, LvSx0 and LySx60 corresponding to grayscales Gmx and Gsx are obtained according to the previously established corresponding relations between the grayscale G and actual luminance values in the main pixel area M and the sub pixel area S, and theoretical luminance values LvGx0 and LvGx60 corresponding to the grayscale Gx are obtained according to the previously established corresponding relationships between the grayscale G and theoretical luminance values; and following equations are calculated:

$$\Delta1=LvMx0+LvSx0-LvGx0;$$

$$\Delta2=LvMx60+LvSx60-LvGx60;$$

$$y=\Delta1^2+\Delta2^2;$$

Through attempts of selecting combination of values of Gmx and Gsx, when a combination of values of Gmx and Gsx makes y in the above equation is minimal, grayscales Gmx and Gsx at this time are set to be grayscales respectively input to the main pixel area M and the sub pixel area S when the pixel unit is at the grayscale Gx.

Finally, as for each grayscale G (0-255) of the pixel unit, the above step is repeated, so that grayscales respectively input to the main pixel area M and the sub pixel area S at all of grayscales (0-255) of the liquid crystal panel are finally obtained.

Figure 5:
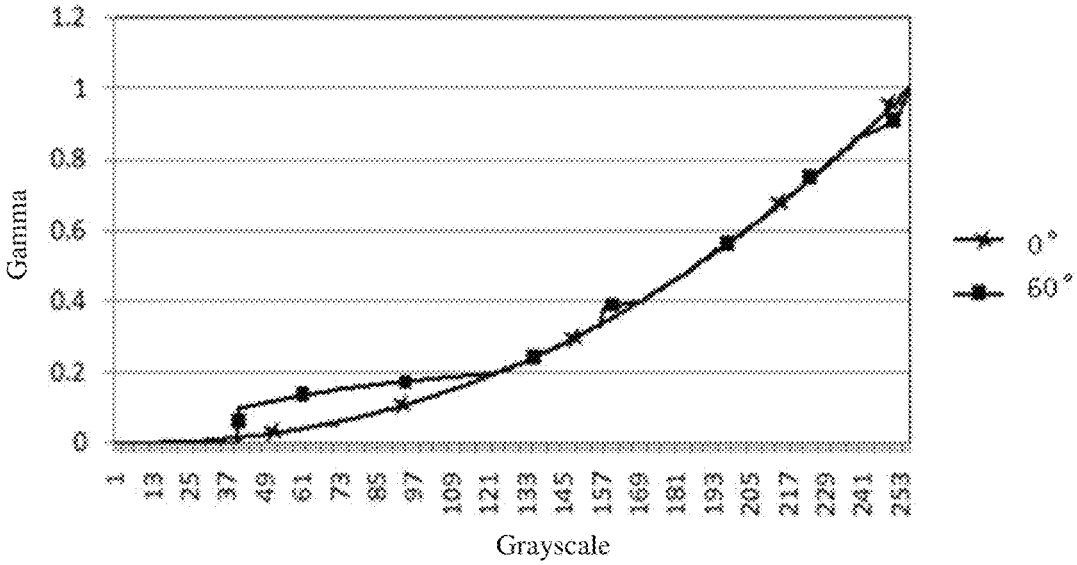
FIG. 5 is a diagram illustrating gamma curve of a liquid crystal panel after grayscale adjustment provided by an embodiment of the present invention.

Gamma curves of the liquid crystal panel at the front view angle 0° and the slant view angle 60° after adjustment of grayscales of the main pixel area M and the sub pixel area S in the present embodiment are illustrated in FIG. 5. The gamma curves obtained in the case where the main pixel area M and the sub pixel area S are in the front view angle and the slant view angle are both approaching gamma(γ)=2.2 by setting grayscales of the main pixel area M and the sub pixel area S, an excellent display effect can be achieved while reducing color shift, and light leak and color shift at a large view angle are reduced in a case of ensuring a display effect at the front view angle not to be apparently varied.

Figure 6:
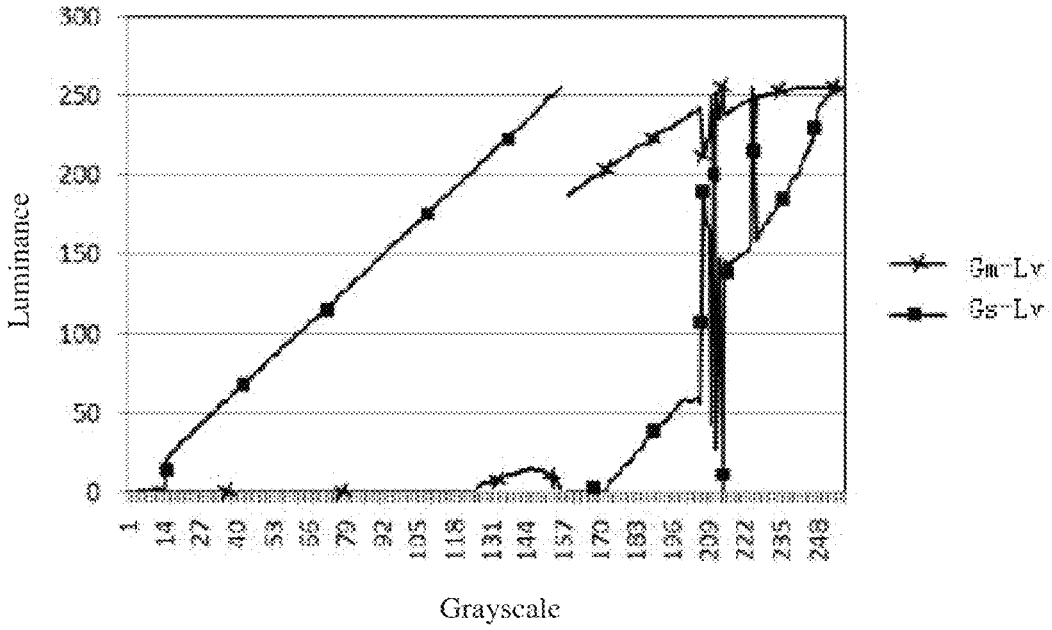
FIG. 6 is a relationship curve between a grayscale and a luminance after grayscale adjustment in an embodiment of the present invention.

FIG. 6 illustrates a Gm-Lv relationship curve between the grayscale and the luminance of the main pixel area M and a Gs-Lv relationship curve between the grayscale and the luminance of the sub pixel area S after the setting according to the above steps. In the relationship curve as illustrated in FIG. 6, a grayscale inversion occurs around a grayscale 157, and there are many singular discrete numerical points on the curve, which affects display quality of the liquid crystal display. In order to solve this problem, the following methods may be adopted to perform a smoothing process to the relationship curve:

(1) A locally weighted regression scatter plot smooting (LOWESS or LOESS) is adopted for performing a smoothing process. LOWESS is similar to a moving average technology, which indicates that in a designated window, a numerical value of each point is obtained by weighted regressing using adjacent data within a window, a regression equation may be a linear equation or a quadratic equation. If data points that are smoothed at both sides of the data point to be smoothed are equal within a width of a designated window, it is called as a symmetrical LOWESS, if the data points at the both sides are not equal, it is called as a non-symmetrical LOWESS. LOWESS usually includes following steps:

(a1) initial weights of respective data points in the designated window are calculated, and weight functions are generally expressed as cubic functions of Euclidean distance ratio of numerical values;

(b1) initial weights are used for regression estimation, estimated residuals are used to define steady weight functions, and new weights are calculated;

(c1) step (b1) is repeated using new weights so as to constantly modify weight functions, and a smooth value at any point can be obtained according to a polynomial and the weights after converging at Nth repeating.

An important parameter for performing a smoothing process to data using a LOWESS lies in selection of the width of the window, excessively wide window results in excessive history data covered by a smooth plot, on the contrary, excessively narrow window causes the "smoothed" data not to be smooth.

Figure 7:
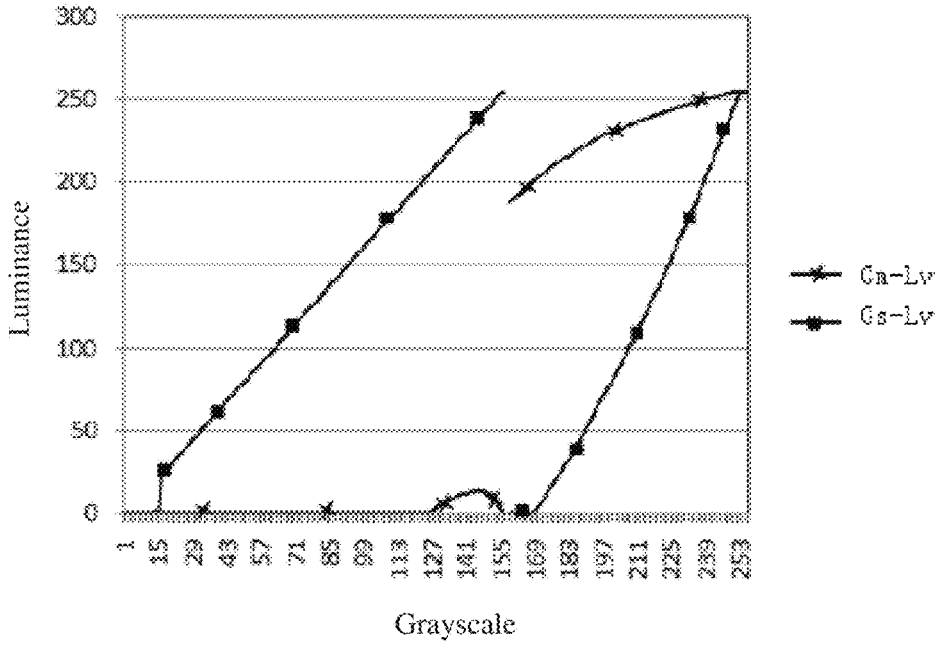
FIG. 7 is a diagram illustrating a curve as illustrated in FIG. 6 after being smooth processed by adopting a method 1 in an embodiment of the present invention.

In the present embodiment, a relationship curve between the grayscale and the luminance after process according to the LOWESS is illustrated in FIG. 7. The relationship curve being processed is smooth and display quality of the liquid crystal display is improved.

(2) A power function fitting process is adopted. A curve fitting is performed after inverting of grayscale (for example, grayscale 157 in the present embodiment), wherein, an expression of the power function adopted in the present embodiment is: f=m*x^n+k.

Figure 8:
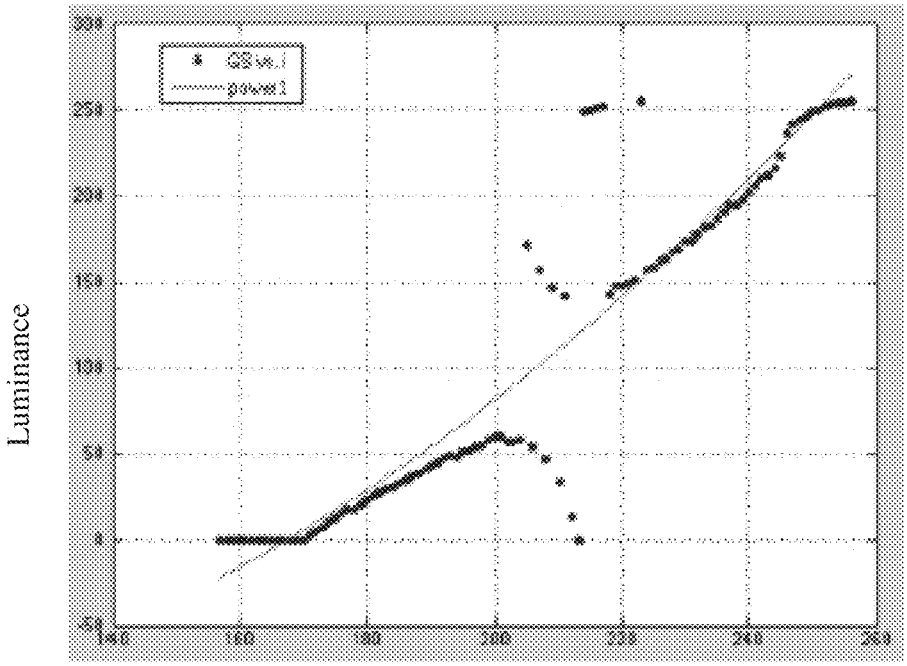
FIG. 8 is a diagram illustrating a smooth processing of a curve as illustrated in FIG. 6 by adopting a method 2 in an embodiment of the present invention.
Figure 9:
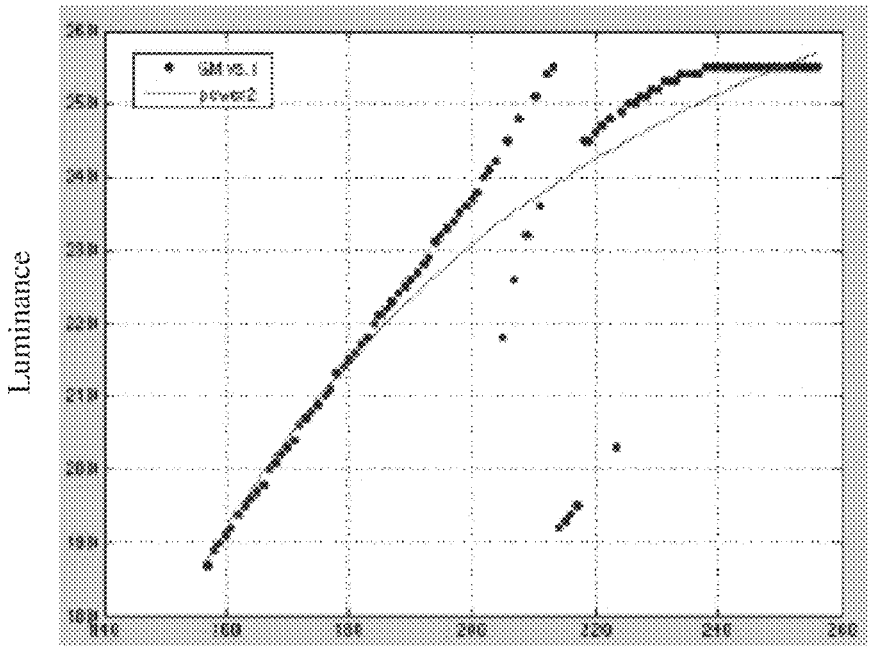
FIG. 9 is a diagram illustrating a smooth processing of a curve as illustrated in FIG. 6 by adopting a method 2 in an embodiment of the present invention.

FIGS. 8 and 9 are diagrams of a power function fitting procedure. FIG. 8 is a diagram of fitting the Gs-Lv relationship curved line between the grayscale and the luminance of the sub pixel area S, a horizontal coordinate in FIG. 8 shows grayscale value starting from an inversion of grayscale, a vertical coordinate shows grayscale corresponding to the sub pixel area S, and a curve power1 is a curve that is obtained by the fitting. FIG. 9 is a diagram of fitting the Gm-Lv relationship curve between the grayscale and the luminance of the main pixel area M, a horizontal coordinate in FIG. 9 shows grayscale value starting from an inversion of grayscale, a vertical coordinate shows grayscale corresponding to the main pixel area M, and a curve power2 is a curve that is obtained by the fitting.

Figure 10:
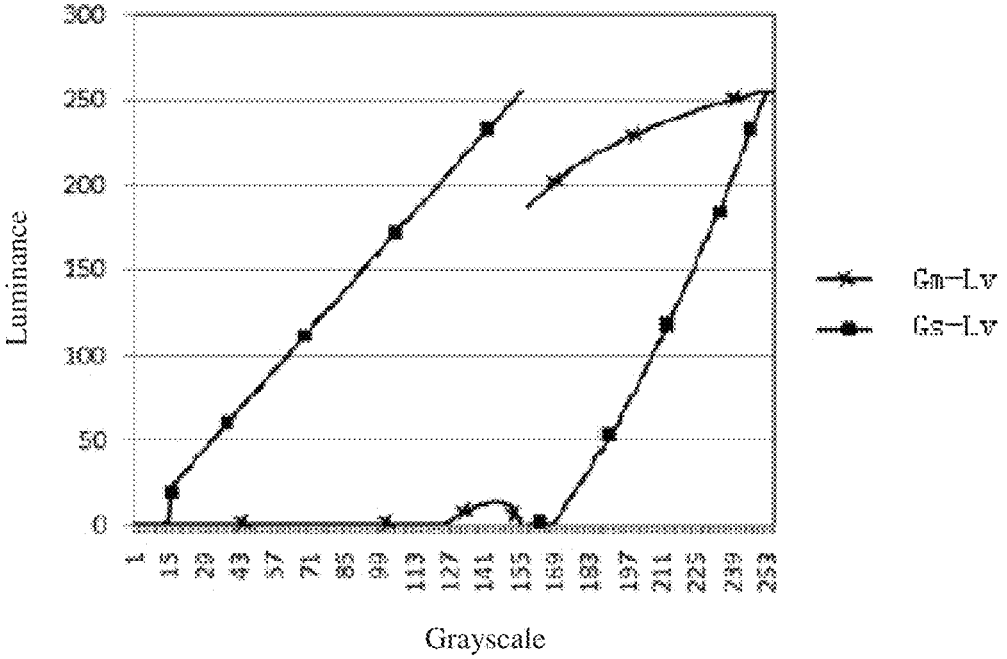
FIG. 10 is a diagram illustrating a curve as illustrated in FIG. 6 after being smooth processed by adopting a method 2 in an embodiment of the present invention.

In the present embodiment, a relationship curve between the grayscale and the luminance after process according to the power function fitting process is illustrated in FIG. 10, which includes a Gm-Lv curve of the main pixel area M and a Gs-Lv curve of the sub pixel area S. The relationship curve being processed is smooth and display quality of the liquid crystal display is improved, and it is simple, rapid and precise to adopt the power function fitting method.

Figure 11:
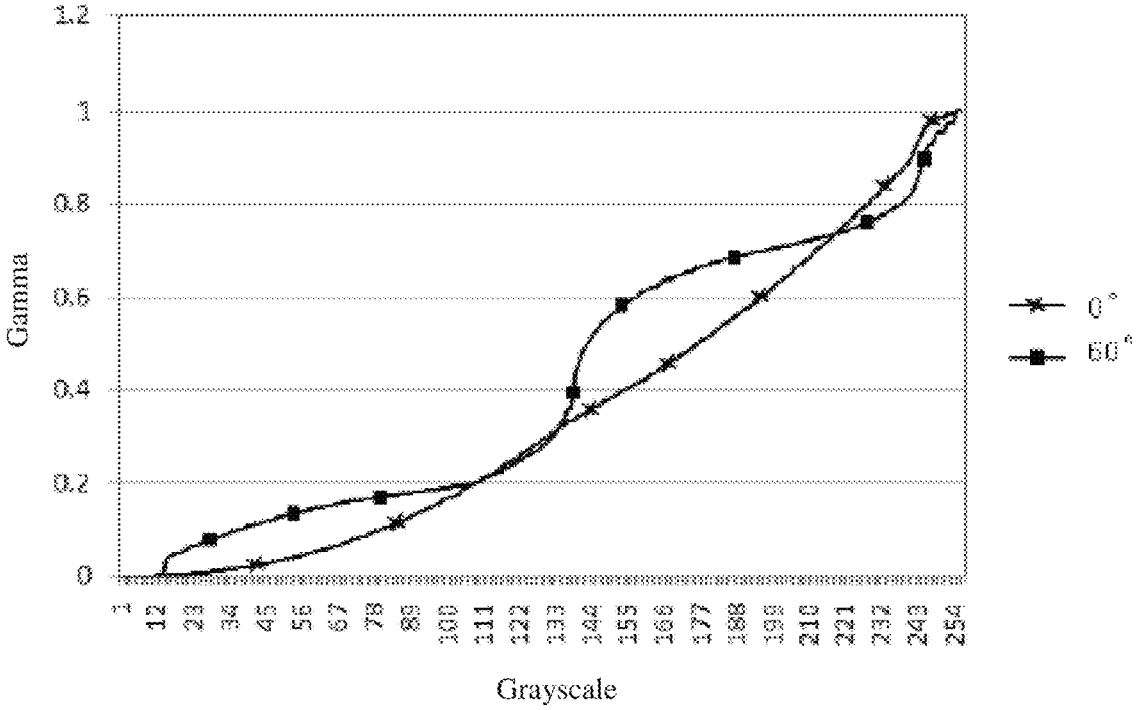
FIG. 11 is a diagram illustrating gamma curve of a liquid crystal panel after grayscale adjustment in another embodiment of the present invention.

In other embodiment, in order to solve the problem that singular discrete numerical points appear, a comparison condition is added to the step of setting grayscales Gmx and Gsx input to the main pixel area M and the sub pixel area S. For example, as for a grayscale Gx (for example, grayscale 100) of the pixel unit, assuming that grayscales input to the main pixel area M and the sub pixel area S are Gmx and Gsx, respectively, and grayscales needed to be input to the main pixel area M and the sub pixel area S of the previous grayscale G(x−1) (grayscale 99) of the pixel unit are Gm(x−1) and Gs(x−1), respectively;

during calculation of following equations, $$\Delta 1 = LvMx\alpha + LvSx\alpha - LvGx\alpha;$$

$$\Delta 2 = LvMx\beta + LvSx\beta - LvGx\beta;$$

$$y = \Delta 1^2 + \Delta 2^2;$$

a following judgment condition is added:

$$Gmx \geq Gm(x-1),\ Gsx \geq Gs(x-1);$$

when the condition Gmx≥Gm(x−1), Gsx≥Gs(x−1) is satisfied and y is minimal, the corresponding grayscales Gmx and Gsx are set to be grayscales respectively input to the main pixel area M and the sub pixel area S when the pixel unit is at the grayscale Gx. After adding the above judgment condition, gamma curves of the liquid crystal panel at the front view angle 0° and the slant view angle 60° are illustrated in FIG. 11.

Since the judgment condition is added, as for a pixel unit, grayscales input to the main pixel area M and the sub pixel area S at a grayscale are respectively not smaller than grayscales input to the main pixel area M and the sub pixel area S at a previous grayscale of the pixel unit, so that there is no singular point in the finally obtained relationship curve between the grayscale and the luminance, and a smooth curve is obtained.

Figure 12:
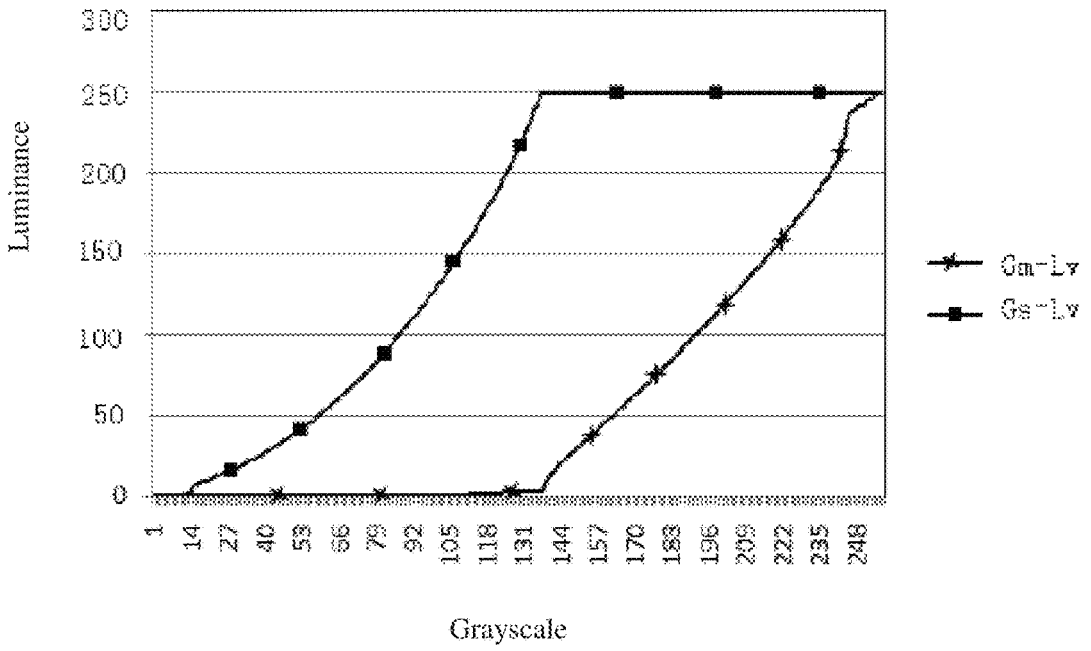
FIG. 12 is a relationship curve between a grayscale and a luminance after grayscale adjustment in another embodiment of the present invention.

FIG. 12 illustrates a Gm-Lv relationship curve between the grayscale and the luminance of the main pixel area M and a Gs-Lv relationship curve between the grayscale and the luminance of the sub pixel area S after the setting according to the above steps with the judgment condition added. It can be seen from FIG. 12 that Gm-Lv curve and Gs–Lv curve are smooth curve, wherein, the luminance of the sub pixel area S is saturate after grayscale 135, hence, setting the grayscale value according to the present embodiment may improve display quality of the liquid crystal display.

In the present embodiment, after the combination of the first grayscale Gm and the second grayscale Gs corresponding to each grayscale is obtained according to the above steps, as for RGB data signals of an image, G is replaced by Gm and Gs according to a White Traking Look up Table (WT LUP), respectively, to obtain a WT LUP of the first display area and a WT LUP of the second display area, R/G/B grayscales G of each pixel in the image are replaced according to the combination of the first grayscale Gm and the second grayscale Gs, finally, the first grayscale Gm is input to the pixel unit of the first display area and the second grayscale Gs is input to the pixel unit of the second display area, and the image is displayed.

To sum up, the display method and display system for an image provided by the present invention is accordingly capable of simulate-evaluating a conversion effect when converting a grayscale value of a pixel unit into a combination of grayscales of a main pixel area and a sub pixel area in order to reduce color shift by simulating displaying of a 2D1G panel in a traditional RGB three-pixel liquid crystal panel, to ensure quality of hardware chip design.

Obviously, the protection scope of the present invention is not limited to the above detailed modes, and those skilled in the art may make various changes and modifications to the invention without departing from the scope and spirit of the invention. As such, if these changes and modifications of the present invention belong to the scope of the claims of the present invention and equivalent technologies thereof, the present invention also intends to include these changes and modifications herein.

The invention claimed is:

1. An image display method, comprising:

providing a liquid crystal panel including a plurality of pixel units;

dividing the liquid crystal panel into a plurality of display units including a first display area which includes A pixel units, and a second display area which includes B pixel units, wherein A and B are integers larger than 0;

providing a data signal of an image;

dividing a grayscale G of the data signal of the image corresponding to a pixel unit into a combination of a first grayscale Gm and a second grayscale Gs; and inputting the first grayscale Gm to the pixel unit of the first display area, inputting the second grayscale Gs to the pixel unit of the second display area, and displaying the image wherein the dividing of the grayscale G into the combination of the first grayscale Gm and the second grayscale Gs particularly comprises the following steps:

(S101) obtaining an actual luminance value Lvα of each grayscale G of the liquid crystal panel at a front view angle α;

(S102) obtaining an actual luminance value Lvβ of each grayscale G of the liquid crystal panel at a slant view angle β;

(S103) dividing each pixel unit of the liquid crystal panel into a main pixel area M and a sub pixel area S with an area ratio of A:B, dividing actual luminance values Lvα and Lvβ according to following equations:

$$LvM\alpha:LvS\alpha=A:B,$$

$$LvM\alpha+LvS\alpha=Lv\alpha;$$

$$LvM\beta:\ LvS\beta=A:B,$$

$$LvM\beta+LvS\beta=Lv\beta;$$

wherein, actual luminance values LvMα and LvMβ of each grayscale G of the main pixel area M at the front view angle α and the slant view angle β are obtained, respectively; and actual luminance values LvSα and LvSβ of each grayscale G of the sub pixel area S at the front view angle α and the slant view angle β are obtained, respectively;

(S104) calculating theoretical luminance values LvGα and LvGβ of each grayscale G of the liquid crystal panel at the front view angle α and the slant view angle β according to actual luminance values Lvα(max) and Lvβ(max) of a highest grayscale max obtained in steps S101 and S102, in conjunction with following equations:

$$\text{gamma}(\gamma) = 2.2 \text{ and } \left(\frac{G}{\max}\right)^{\gamma} = \frac{LvG}{Lv(\max)}$$

(S105) as for a grayscale Gx in the pixel unit, assuming that grayscales input to the main pixel area M and the sub pixel area S are Gmx and Gsx, respectively, obtaining actual luminance values LvMxα, LvMxβ, LvSxα and LvSxβ according to a result of step (S103) obtaining theoretical luminance values LvGxα and LvGxβ according to a result of step (S104); and calculating following equations:

$$\Delta I=LvMx\alpha+LvSx\alpha-LvGx\alpha;$$

$$\Delta I=LvMx\beta+LvSx\beta-LvGx\beta;$$

$$y=\Delta 1^2+\Delta 2^2;$$

wherein, when y is minimal, setting corresponding grayscales Gmx and Gsx to be grayscales respectively input to the main pixel area M and the sub pixel area S when the pixel unit is at the grayscale Gx; and (S106) repeating step (S105) with respect to each grayscale G of the pixel unit to complete dividing of the grayscale G into the combination of the first grayscale Gm and the second grayscale Gs.

2. The image display method in claim 1, wherein the front view angle α is 0°, and the slant view angle β is 30-80°.

3. The image display method in claim 2, wherein the slant view angle β is 60°.

4. The image display method in claim 1, wherein the grayscales of the liquid crystal panel includes 256 grayscales from 0-255, wherein the highest grayscale max is grayscale 255.

5. The image display method in claim 1, wherein the actual luminance values Lvα and Lvβ are determined according to gamma curves which are gamma curves of the liquid crystal panel obtained at the front view angle α and the slant view angle β.

6. The image display method in claim 1, wherein, after step S106, a Gm-Lv relationship curve between the grayscale and the luminance of the main pixel area M and the Gs-Lv relationship curve between the grayscale and the luminance of the sub pixel area S are obtained, and a singular point appearing in the Gm-Lv relationship curve and the Gs-Lv relationship curve is processed by adopting a locally weighted regression scatter plot smoothing method or a power function fitting process.

7. The image display method in claim 1, wherein in S105, a judgment condition is added:

wherein, when the condition Gmx>Gm(x−1), Gsx>Gs(x−1) is satisfied and y is minimal, the corresponding grayscales Gmx and Gsx are set to be grayscales respectively input to the main pixel area M and the sub pixel area S when the pixel unit is at the grayscale Gx.

8. The image display method in claim 1, wherein a:b=2:1 or 3:1.

9. An image display system, comprising:

a liquid crystal panel which is divided into a plurality of display units including a first display area which includes A pixel units and a second display area which includes B pixel units wherein A and B are integers larger than 0;

a data signal receiving unit for receiving a data signal of an image; and a data signal processing unit coupled to the data signal receiving unit for dividing a grayscale G of the data signal of the image corresponding to the pixel unit into a combination of a first grayscale Gm and a second grayscale Gs, wherein, the data signal processing unit being coupled to the liquid crystal panel, inputting the first grayscale Gm to the pixel unit of the first display area, inputting the second grayscale Gs to the pixel unit of the second display area, and displaying the image in the liquid crystal panel;

wherein the dividing of the grayscale G into the combination of the first grayscale Gm and the second grayscale Gs particularly comprises the following steps:

(S101) obtaining an actual luminance value Lvα of each grayscale G of the liquid crystal panel at a front view angle α;

(S102) obtaining an actual luminance value Lvβ of each grayscale G of the liquid crystal panel at a slant view angle β;

(S103) dividing each pixel unit of the liquid crystal panel into a main pixel area M and a sub pixel area S with an area ratio of A:B, dividing actual luminance values Lvα and Lvβ according to following equations:

$$LvM\alpha:LvS\alpha=A:B,$$

$$LvM\alpha+LvS\alpha=Lv\alpha;$$

$$LvM\beta:\ LvS\beta=A:B$$

$$LvM\beta+LvS\beta=Lv\beta;$$

wherein, actual luminance values LvMα and LvMβ of each grayscale G of the main pixel area M at the front view angle α and the slant view angle β are obtained, respectively; and actual luminance values LvSα and LvSβ of each grayscale G of the sub pixel area S at the front view angle α and the slant view angle β are obtained, respectively;

(S104) calculating theoretical luminance values LvGα and LvGβ of each grayscale G of the liquid crystal panel at the front view angle α and the slant view angle β according to actual luminance values Lvα(max) and Lvβ(max) of a highest grayscale max obtained in steps S101 and S102, in conjunction with following equations:

$$\text{gamma}(\gamma) = 2.2 \text{ and } \left(\frac{G}{\max}\right)^{\gamma} = \frac{LvG}{Lv(\max)}$$

(S105) as for a grayscale Gx in the pixel unit, assuming that grayscales input to the main pixel area M and the sub pixel area S are Gmx and Gsx, respectively, obtaining actual luminance values LvMxα, LvMxβ, LvSxα and LvSxβ according to a result of (S103), obtaining theoretical luminance values LvGxα and LvGxβ according to a result of step (S104); and calculating following equations:

$$\Delta I=LvMx\alpha+LvSx\alpha-LvGx\alpha;$$

$$\Delta I=LvMx\beta+LvSx\beta-LvGx\beta;$$

$$y=\Delta 1^2+\Delta 2^2;$$

wherein, when y is minimal, setting corresponding grayscales Gmx and Gsx to be grayscales respectively input to the main pixel area M and the sub pixel area S when the pixel unit is at the grayscale Gx; and (S106) repeating step (S105) with respect to each grayscale G of the pixel unit to complete dividing of the grayscale G into the combination of the first grayscale Gm and the second grayscale Gs.

10. The image display system in claim 9, wherein the front view angle α is 0°, and the slant view angle β is 30-80°.

11. The image display system in claim 10, wherein the slant view angle β is 60°.

12. The image display system in claim 9, wherein, the grayscales of the liquid crystal panel includes 256 grayscales from 0-255, wherein the highest grayscale max is grayscale 255.

13. The image display system in claim 9, wherein the actual luminance values Lvα and Lvβ are determined according to gamma curves which are gamma curves of the liquid crystal panel obtained at the front view angle α and the slant view angle β.

14. The image display system in claim 9, wherein after step S106, a Gm-Lv relationship curve between the grayscale and the luminance of the main pixel area M and the Gs-Lv relationship curve between the grayscale and the luminance of the sub pixel area S are obtained, and a singular point appearing in the Gm-Lv relationship curve and the Gs-Lv relationship curve is processed by adopting a locally weighted regression scatter plot smoothing method or a power function fitting process.

15. The image display system in claim 9, wherein in S105, a judgment condition is added:

wherein, when the condition Gmx>Gm(x−1), Gsx>Gs(x−1) is satisfied and y is minimal, the corresponding grayscales Gmx and Gsx are set to be grayscales respectively input to the main pixel area M and the sub pixel area S when the pixel unit is at the grayscale Gx.

16. The image display system in claim 9, wherein a:b=2:1 or 3:1.

* * * * *